US006264492B1

(12) United States Patent
LaLaouna et al.

(10) Patent No.: US 6,264,492 B1
(45) Date of Patent: Jul. 24, 2001

(54) COMPACT BRANCH CONNECTOR FOR AT LEAST ONE BRANCH CABLE INTO A MAIN CABLE

(75) Inventors: Said LaLaouna, Barcelone (ES); Jean-Luc Couvert, Bevenais (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/586,157

(22) Filed: Jun. 2, 2000

(30) Foreign Application Priority Data

Jun. 3, 1999 (FR) ..... 99 07162

(51) Int. Cl.[7] ..... H01R 4/24
(52) U.S. Cl. ..... 439/402
(58) Field of Search ..... 439/402, 411, 439/781, 271, 413, 521, 811, 892

(56) References Cited

U.S. PATENT DOCUMENTS

| | | | | |
|---|---|---|---|---|
| 1,943,020 | | 1/1934 | Johnson | 173/273 |
| 3,848,956 | * | 11/1974 | Kraft Russell . | |
| 4,427,253 | | 1/1984 | Smith et al. | 339/98 |
| 4,643,512 | * | 2/1987 | Prodel | 339/248 R |
| 4,684,196 | * | 8/1987 | Smith et al. | 439/411 |
| 4,964,813 | * | 10/1990 | Francois et al. | 439/521 |
| 4,985,003 | | 1/1991 | Francois et al. | 439/781 |
| 5,015,198 | | 5/1991 | Delin | 439/411 |
| 5,041,012 | * | 8/1991 | Caprio | 439/413 |
| 5,302,144 | * | 4/1994 | Francois et al. | 439/781 |
| 6,086,406 | * | 7/2000 | Francois et al. | 439/402 |
| 6,106,323 | * | 8/2000 | Elisei et al. | 439/395 |

FOREIGN PATENT DOCUMENTS

| | | |
|---|---|---|
| 2601516 | 1/1988 | (FR) . |
| 2744289 | 8/1997 | (FR) . |

* cited by examiner

*Primary Examiner*—Gary Paumen
*Assistant Examiner*—P Nguyen
(74) *Attorney, Agent, or Firm*—Perman & Green, LLP

(57) ABSTRACT

The invention addresses an electric connector for the assembly of at least one branch cable (24) into a main cable (26) of the type comprising a lower body (10) and an upper body (12) both having contact blades (18), means (20, 22) for accommodating these cables between the two bodies, as well as clamping means, characterized in that the means (20) for accommodating the branch cable/s (24) comprise a tube having apertures for the passage of the ends of the contact blades (18).

15 Claims, 6 Drawing Sheets

COMPACT BRANCH CONNECTOR FOR AT LEAST ONE BRANCH CABLE INTO A MAIN CABLE

BACKGROUND OF THE INVENTION

1. Field of the Invention

The present invention relates to a compact branch connector allowing to connect at least one branch cable into one main cable and, when two branch cables are provided, allowing to connect them separately.

2. Description of the Prior Art

Branch connectors are known which allow to make connections of one branch cable into a main line, particularly into electric live cables, by perforation of the insulating material.

Independent connections for each phase are needed, which means that three connections are required for three-phase current, or four in the case of a three-phase line with the addition of a ground cable.

The problem consists in providing compact branch connectors while reducing the size of these connectors which are generally successively immersed in an insulating resin inside a cleat.

Moreover, since cables are energized in most applications, it might be useful to provide arrangements preventing the cable to be peeled off for branch connection.

Another restriction imposed by specifications is to provide a secure connection, which means that the operator shall be certain, during the installation, that he connector is properly mounted. To this end, all lamping operations shall be performed with torque meters.

From patent application FR-A-2 744 289 U.S. Pat. No. 6,086,406, a branch connector for an underground cable is known, which comprises two parts, an upper part and a lower part, fastened together by a central screw having means for controlling the clamping torque mutually exerted by the upper and lower parts.

These two parts have a housing, perpendicular to the clamping direction, on one side, designed to accommodate the end/s of one or two branch cables, shutters ensuring that the housings are closed when they are not used and, on the other side, a housing formed by two half-grooves of the upper and lower parts respectively.

Two transverse conductive blades, also borne by the upper and lower parts respectively, perforate and cut at the same time the insulating sleeves of the main and branch cables to contact their conductive cores.

SUMMARY OF THE INVENTION

This invention proposes a connector for at least one branch cable into a main cable, which has a high compactness, which allows to connect the different cables without having to peel them off, which allows to connect one or two branch cables into a main cable separately, which allows to orient the connector with respect to the cable, which includes installation aids, which is reliable and includes integrally molded parts for an optimized industrial production.

Therefore, in accordance with the invention, the electric connector for assembling at least one branch cable into a main cable of the type comprising a lower body and an upper body both having contact blades, means for accommodating these cables between the two bodies, as well as clamping means, is characterized in that the means for accommodating the branch cable/s comprise a tube having apertures for the passage of the contact blades.

According to another characteristic, the blades are disposed in flexible insulating cleats, accommodated in housings formed in the lower and upper bodies, only the contact blades protruding out of these cleats.

Preferably, the cleats penetrate the apertures of the tube so that continuity of electric insulation is ensured.

This tube further comprises shutter means in the median part, which also form a positioning abutment for the ends of the branch cables, as well as at the entries. Such means advantageously consist in open slots, arranged transversely to the tube and receiving sliding flap shutters, the latter comprising elastic fingers for locking them in the inserted position.

Regarding the clamping means, they comprise a threaded housing formed in the lower body and a screw whose shank passes through the upper body inside an elongated hole, which allows reciprocal self-positioning of the two bodies upon clamping.

Further, according to the invention, this screw has at its head a calibrated rupture clamping device such as a screw cap.

According to a further characteristic, the lower and upper bodies comprise guide pins and through holes for these pins respectively, with calibrated rupture means for abutment during their sliding motion, and safety means for the extraction of the pins out of the holes after insertion thereof.

According to a preferred arrangement, the tube comprises split rings between the two bodies, for cooperation with the guide pins.

Each of the two bodies has a Y shape, consisting of a half-base and two stems, symmetric to a median plane P, as well as means for accommodating the contact blades.

BRIEF DESCRIPTION OF THE DRAWINGS

The present invention will be described in further detail according to a particular non-limiting embodiment thereof, with reference to the accompanying drawings, whose different figures show.

DESCRIPTION OF THE PREFERRED EMBODIMENT

Figure 1:
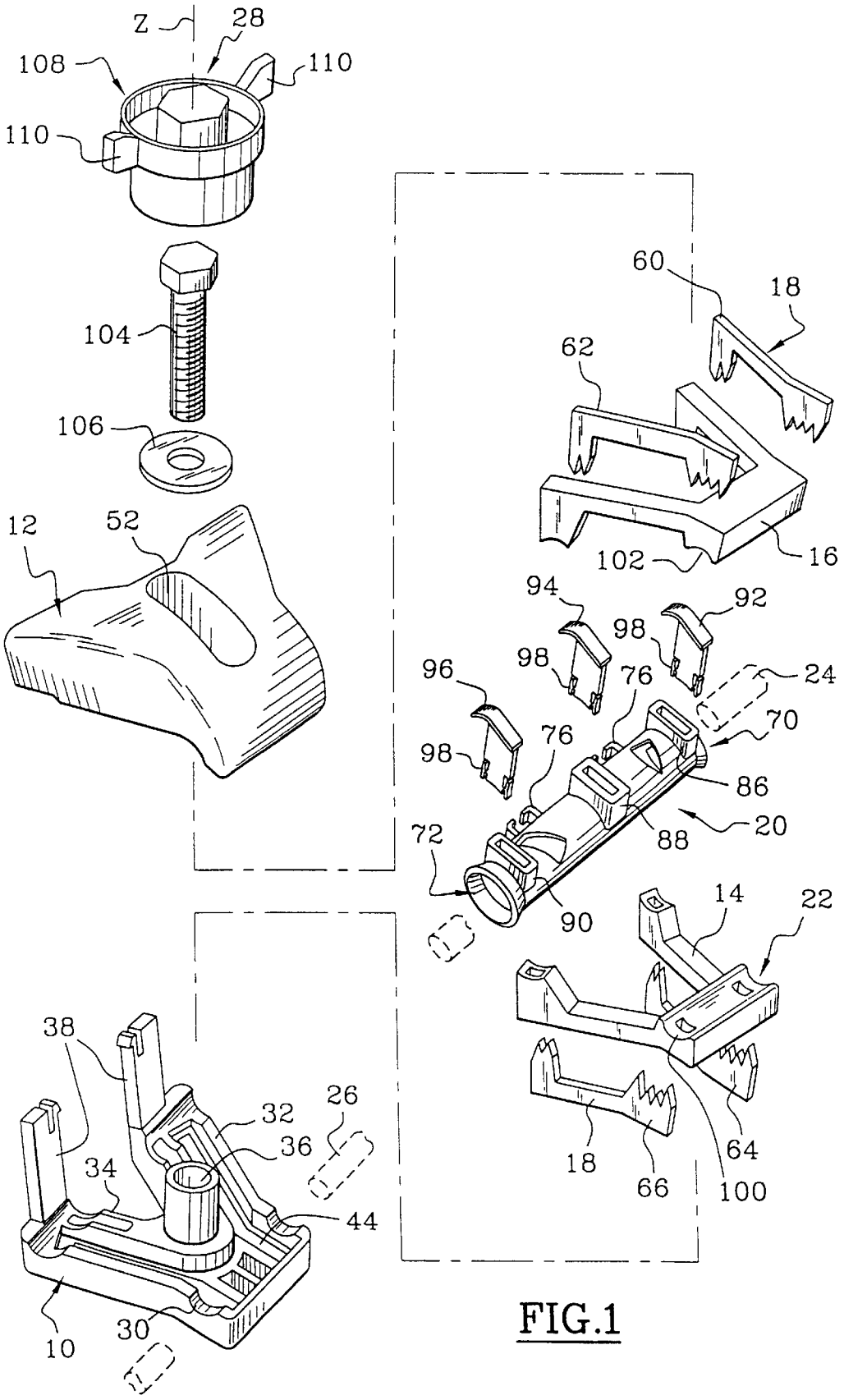
FIG. 1, a perspective exploded view of the connector according to the invention, FIG. 2, a perspective view of the connector of FIG. 1, as seen from the side of the means for accommodating the branch cables, in the pre-assembled position, before laying the cables, FIG. 3, a perspective view of the connector of FIG. 2, in the same position but as seen from the side of the means for accommodating the main cable, FIG. 4A, a bottom view of the lower body accommodating the electric connection blades mounted in flexible insulating cleats, FIG. 4B, a side elevational view of the lower body as shown in FIG. 4A, FIG. 5A, a bottom view of the upper body accommodating the electric connection blades mounted in the flexible insulating cleats, FIG. 5B, a side elevational view of the upper body as shown in FIG. 5A, FIG. 5C, a side elevational view of the upper body as shown in FIG. 5B, in a 90° orientation, FIG. 6A, a side elevational longitudinal view of the tube for accommodating the branch cable/s, FIG. 6B, a bottom longitudinal view of the tube for accommodating the branch cable/s, and FIG. 7, a diagrammatic view of the clamped connector with a considerable diameter difference between the main cable and the branch cable.
Figure 2:
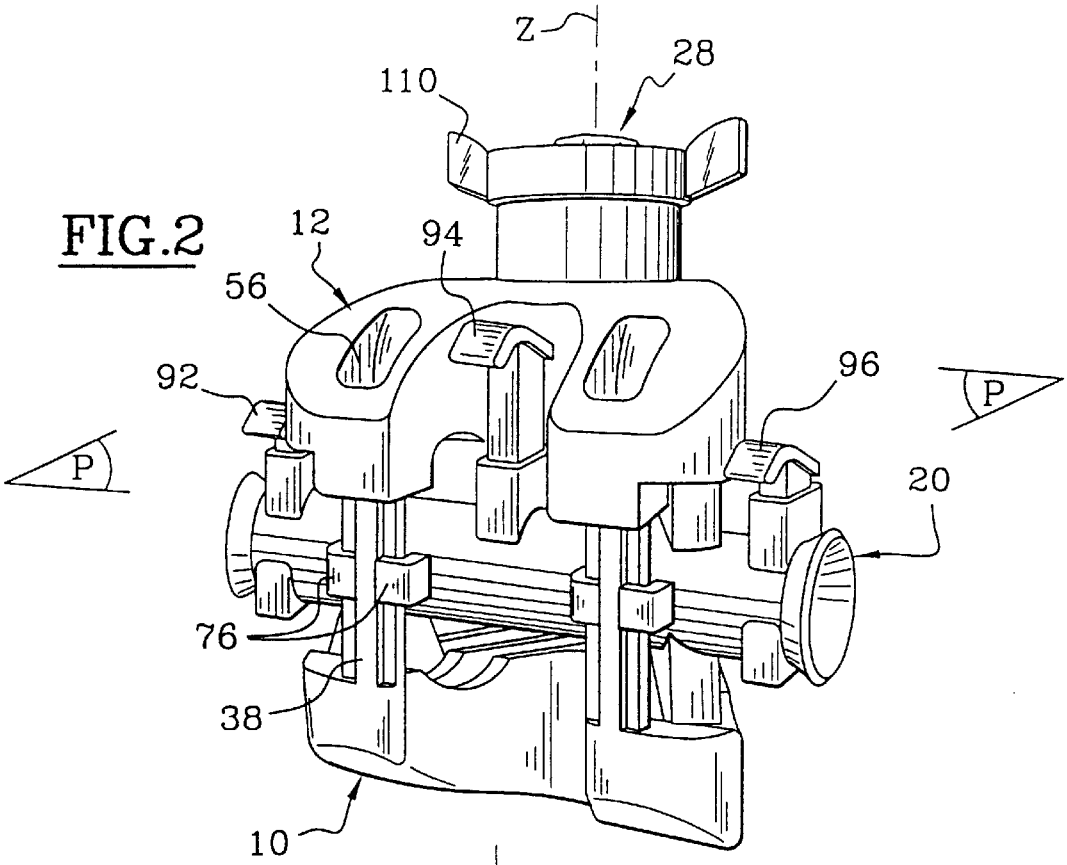
Figure 3:
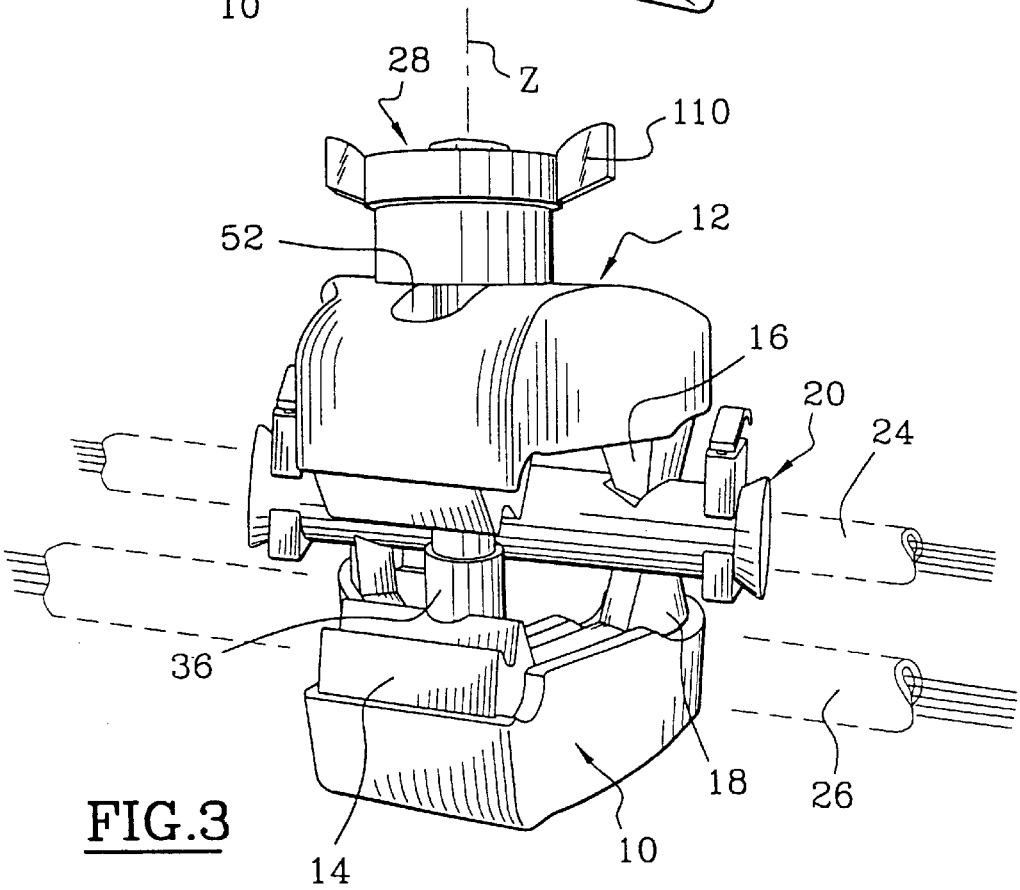

The invention will be now described in further detail with basic and equal reference to FIGS. 1, 2 and 3, the detailing figures using the same reference numerals.

The connector comprises a lower body 10 and an upper body 12 made of an insulating material and provided in such a manner as to be clamped one against the other, a lower insulating cleat 14 and an upper insulating cleat 16, each accommodating electric connection blades 18, means 20 and 22 for accommodating at least one branch cable 26 and one main cable 26 respectively, outlined in a very simplified manner in dashed lines, as well as directional clamping means 28.

Figure 4A:
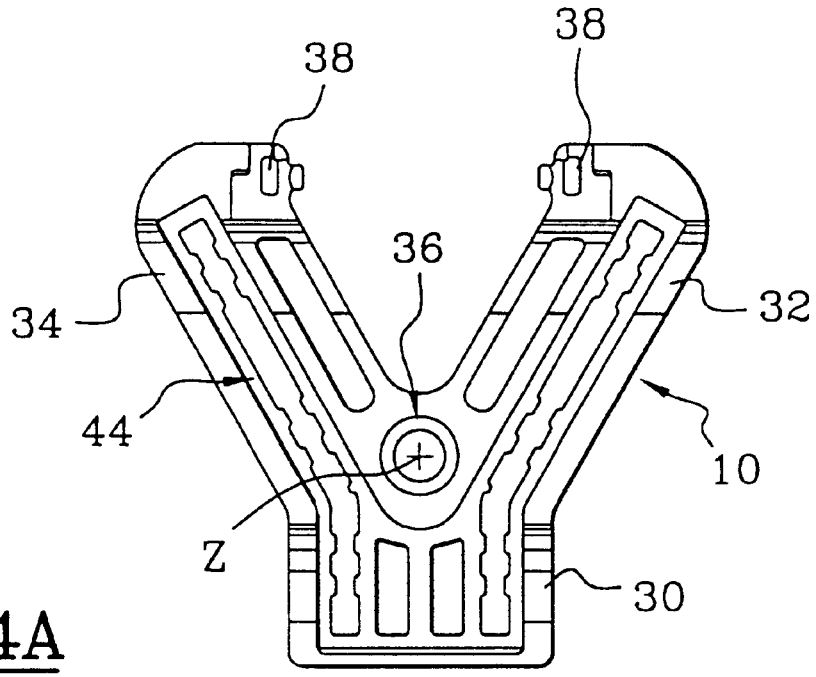
Figure 4B:
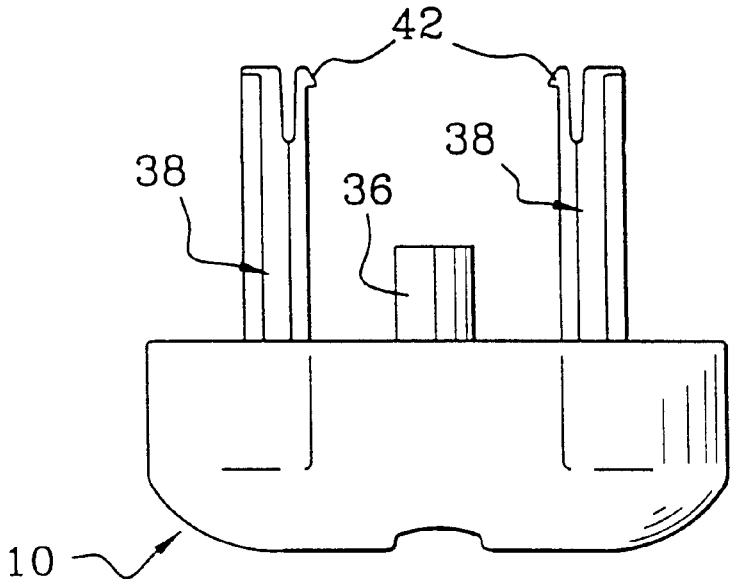

As shown in FIG. 4A, the lower body 10 has an Y-shaped bottom side, having a first half-base 30 and two stems 32, 34. A threaded housing 36 is provided substantially at the geometric center of this body.

This housing 36 protrudes and is oriented perpendicular to the plane of the body, i.e. perpendicular to the longitudinal axis of the cables, this direction being thereafter referred to as Z.

At the ends of each stem 32 and 34, guide pins 38 are formed of one piece with the lower body. These pins comprise elastic retaining hooks 42.

The lower body 10 has a housing 44, also Y-shaped, substantially centered with respect to the whole body, the housing being provided to accommodate the lower insulating cleat 14, having a mating profile.

Figure 5A:
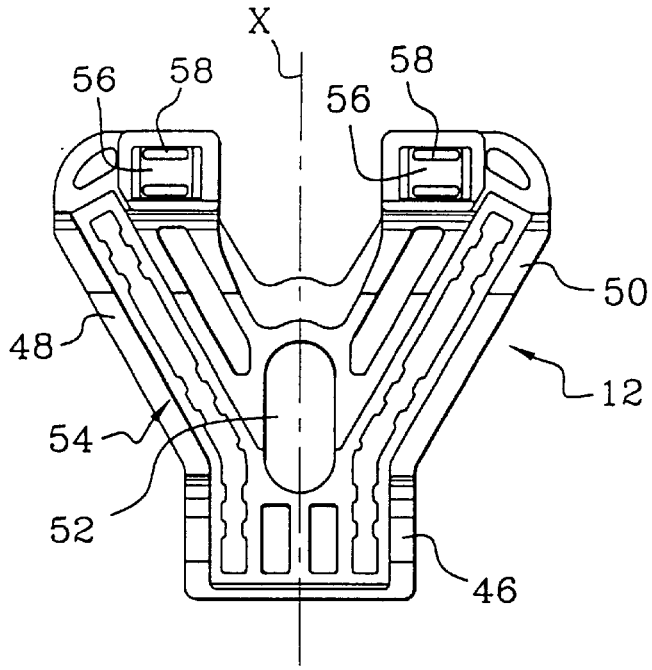

As shown in FIG. 5A, the upper body 1 also has a Y-shaped bottom side, with a second half-base 46, symmetric to the first base 30 with respect to the median contact plane P, which is perpendicular to the clamping axis Z. This body also comprises two stems 48, 50, symmetric to the stems 32 and 34 with respect to said plane P. A hole 52, having an elongated shape, whose longer axis is superposed on the axis X passing between the stems of the Y shape, is provided substantially at the geometric center of this upper body 12.

In FIG. 5A, the numeral 54 denotes a Y-shaped housing, equivalent to the housing 44 of the lower body 10, provided to accommodate the matching upper insulating cleat 16.

Figure 5B:
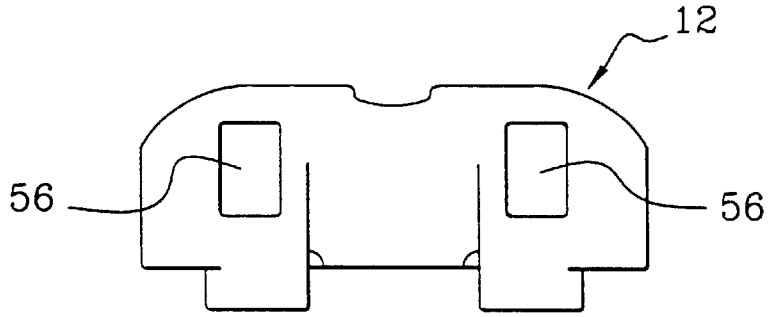

In FIG. 5B, two through holes 56 are shown, parallel to the clamping axis Z, and disposed in such a manner as to face the guide pins 38 borne by the lower body 10 and to allow the passage thereof.

In each of these holes, calibrated rupture temporary stops 58 for the guide pins 38 protrude inwardly.

Figure 5C:
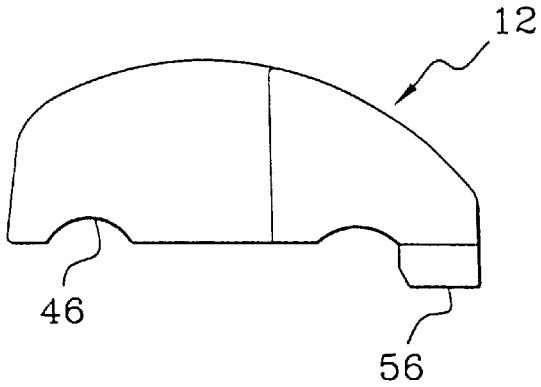

FIG. 5*c* shows more clearly the asymmetric dome shape of the bottom of the upper body 12 in the transverse direction.

Two pairs of independent electric connection blades 60, 62; 64, 66 are provided, which are made of a conductive material having a sufficient stiffness to ensure that the insulating materials of the cables are perforated. Each blade is accommodated in the housing of the corresponding stem of the cleat wherein it is inserted or molded, the material preferably being a flexible polymer.

Also, in each of the lower and upper bodies, there are provided two blades whose ends at the branch cable side are spaced apart and the ends at the main cable side are close together.

This is a particularly interesting advantage, allowing to accommodate several connectors of this type, each on the cable of one of the phases of the main harness, which provides, over a short length, an assembly of the required compactness.

In a suitable manner, the ends of the contact blades have increasingly deep teeth, which form a curve fitting the diameter of the cables or which have the same height but are oriented radially, the average diameter of the cables to be laid being also considered, so that a good penetration may be achieved.

The means 20, 22 for accommodating at least one branch cable 24 and one main cable 26 comprise, regarding the former, a housing cylindrical tube 68. This tube has two entries 70, 72 at its ends, each having a lead-in cone.

The tube comprises means 74 for fastening it to the lower body 10. More exactly, in the preferred mode, these fastening means are split rings 76 designed for sliding on the guide pins 38 and mounted, perpendicularly, along a generator of the tube, for the latter to be perpendicular to the clamping axis Z when it is in its proper position.

Figure 6A:
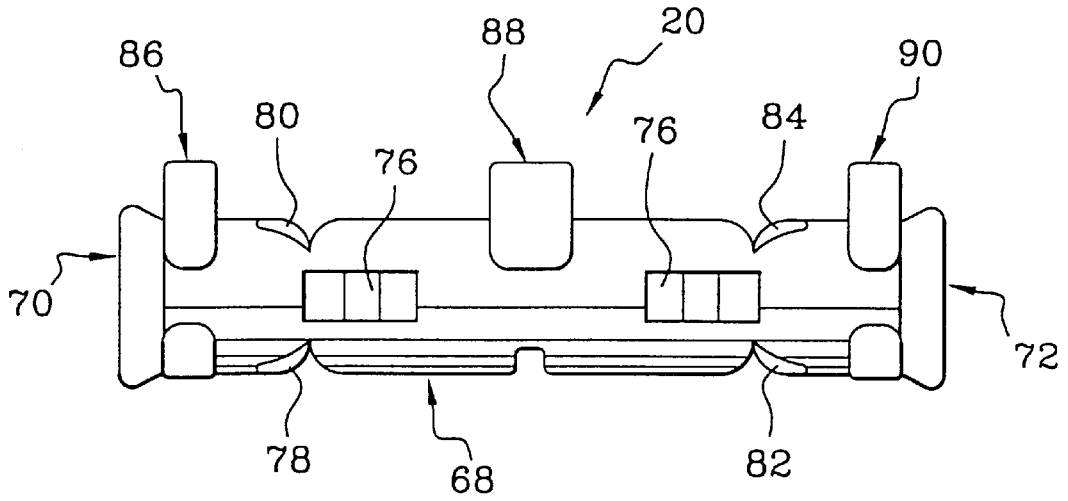
Figure 6B:
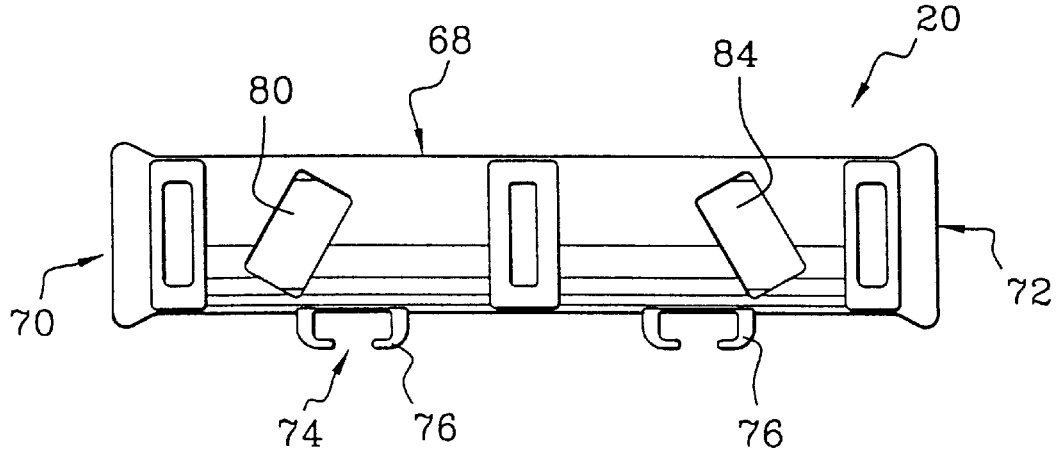
Figure 7:
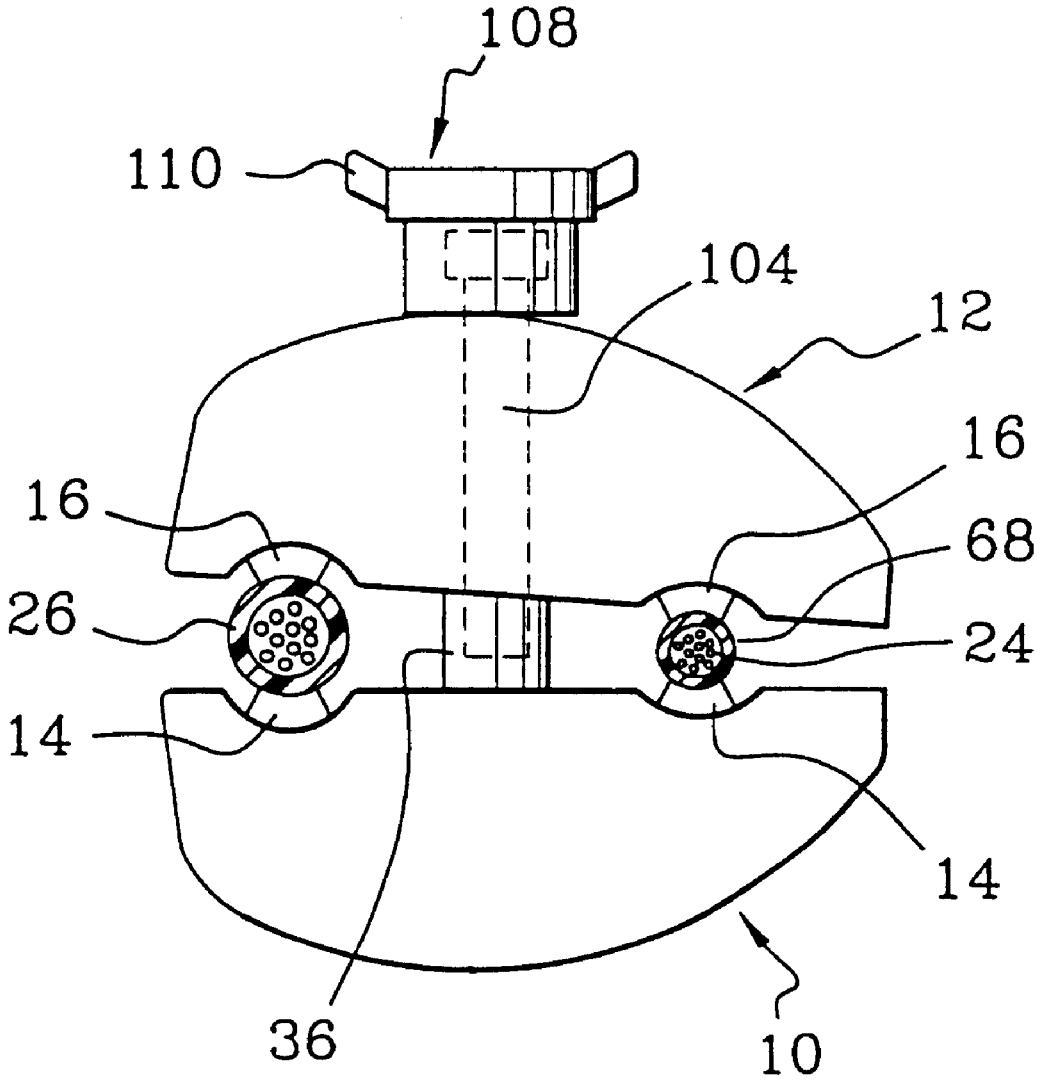

The tube, as shown in detail in FIGS. 6A and 6B has two pairs of apertures 78, 80; 82, 84, in the proximity of the first and second entries 70 and 72 respectively.

These apertures are so oriented as to be inclined with respect to the longitudinal axis of the branch cables and of the cables more generally, to allow the passage of the ends of the cleats of each contact blade protruding therefrom. It is for this reason that the apertures are much larger than contact blades. So, the ends of the cleats ensure continuity of insulation with the tube, at the external side of the apertures.

It can be further noted that the contact blades have a wider contact surface, which is an advantage because branch cables generally have a smaller section as compared with the main cable.

The tube also has slots, three in number, 86, 88, 90, whereof one 88 is provided at the center and the other two 86, 90 substantially juxtapose the cone of each of the entries 70, 72. These slots are open and oriented transverse to the tube. Protruding guiding walls are provided in the upper part.

These slots are designed to accommodate flap shutters 92, 94, 96.

These passing shutters have elastic fingers for locking them in the inserted position.

The median shutter 94 divides the tube 68, into two inner half-tubes. The other two shutters 92, 96 ensure that the entries 70, 72 are shut when they are not used.

The means 22 for accommodating the main cable simply comprise two semi-cylindrical seats 100, 102 arranged at the lower and upper bodies as well as in the cleats 14 and 16.

An upper and a lower blades are shown, which are positioned on both sides of the main cable.

The different blades have a small gap therebetween, which does not affect the electric efficacy due to their being on the same cable, and provides an important advantage in view of compactness.

In the retained embodiment, the orientable clamping means 28 comprise a screw 104 whose threaded shank passes through an elongated hole 52 formed in the upper body 12 and cooperates with the threaded housing 36 of the lower body 10 by being screwed therein. A support washer 106 allows to distribute the clamping pressure, despite the presence of the hole.

A calibrated rupture clamping device such as a screw cap 108 is molded on the screw head 104, said cap having adjusting ears 110. The adjusting ears 110 are joined to the cap by first calibrated rupture rotary connection means and the screw cap is provided with second calibrated rupture rotary means for connecting it to the screw head 104.

The installation of the connector will be now described in detail.

The operator shall first separate the cables of the different phases from the main harness, so that a connector according to the present invention may be mounted thereon. As is apparent, the insulating material which envelopes the harness shall only be retracted over a short length, thanks to the small size of the connectors being used. No cable must be peeled off.

In the case of a single branch cable to be connected, the latter is inserted in the tube 68 through the entry 70 after removing the first shutter 92 and the median shutter 94. Then, the cable is inserted all over the length of the tube until it abuts against the last shutter 96. For apparent purposes of additional visual control, advantages are obtained from making the tube from a transparent material.

So, the branch cable may be safely held by the operator, even when it is energized.

The upper body is kept at a distance from the lower body by temporary stops 58 which prevent the guiding pins 38 from sliding inside the holes 56. It is also apparent that the upper body cannot be separated from the lower body since the elastic hooks 42 ensure connection therebetween.

In this manner, the blades 18 in their insulating cleats 14 and 16 are spaced apart and allow the branch cable to penetrate the tube.

Similarly, the operator can pinch the cable corresponding to a particular phase of the main harness like a jaw, the cable being positioned in the two semi-cylindrical seats 100, 102 provided at the lower and upper bodies as well as in the cleats 14 and 16.

Once the two cables are positioned substantially parallel to each other, the operator can start clamping. To this end, the operator controls the ears 110 of the screw cap 108 and causes this cap to rotate and to drag along the screw head 104 which cooperates with the thread of the housing 36 of the lower body. This action drives the two bodies closer and allows the connector to be clamped on the main conductor. Clamping is performed manually until the first calibrated rupture rotary connection means between the ears and the clamping cap are torn off, with no potential difference being created.

Further, the clamping operation is continued by means of a wrench driving the hexagonal head of the screw cap 108. This clamping action causes the controlled rupture temporary stop elements 58 to be broken. At the same time, as the two bodies 1 are driven closer to each other, the blades 18 penetrate by their teeth the conducting core of the main and branch cables after passing through the cleats and the insulating materials of the main and branch cables.

When the second calibrated rupture means interposed between the screw head and the screw cap are torn off, the clamping torque has reached a sufficient value to ensure the durability of electric contacts, while preventing any overclamping.

The cleats abut on the insulating material of the cables, thereby ensuring the continuity of insulation and preventing any access to a conducting part of the blades, even after clamping.

The contact surface is improved for the branch cable, because the lower and upper contact blades form an angle of contact with respect to the cable axis. In this embodiment the electric contact is particularly good in quality, because the two pairs of blades penetrate the same branch cable.

It can also be noted that this connector has a wider application range, related to the diameters of the main cable whereto it can be connected.

In fact, when a sufficiently important diameter difference exists between the main cable and the branch cable, during the clamping action the upper body swings thanks to the elongated hole with respect to the screw 104 and directs itself to ensure a suitable clamping stress, distributed to all the cables, as shown in FIG. 9.

The connectors are shown to have a trapezoid shape, allowing the operator to mount a first connector on a first cable of the main harness, and a second connector on a second cable of the harness, the two connectors being positioned substantially head to foot, which allows a considerable space gain. Then, particularly on a four-cable harness, the compactness of the mounted connectors according to the invention appears to be interesting.

Where the operator needs to connect two branch cables into the same cable of a main harness, the procedure to be followed, in the main steps, is the same as the one described above, with a few variants. First, the median flap shutter 94 is kept in its position, while the shutters 92 and 96 are removed. Then, the first branch cable is inserted through the first entry 70 until it abuts against the median shutter 94 and the second branch cable is also inserted into the tube through the entry 72 until it also abuts against the median shutter 94.

In this manner, the cables are surely well positioned with respect to the contact blades. Without this arrangement, one of the cables might be perforated by one of the pairs of blades and partially by the other while the other cable might slip out or be poorly penetrated by the blades, which would not provide a reliable connection.

Then the operator starts clamping after pinching the main cable.

The above advantages are also found in this variant.

A very particular advantage of the Y shape is shown, i.e. that it allows, even in the case of two branch cables, to increase the safe distance between the end of the branch connector and the perforation point.

The connector described according to a preferred embodiment shows to be adaptable to the problems mentioned hereinbefore. Thanks to this connector the operators who have to work on live lines can avoid the use of special seals because there is no contact with the conductors, which is a considerable facilitation to their work and avoids the need to break off the circuit, which is an annoyance for users.

The assembly of the insulating parts may be fabricated my molding, which is interesting from an industrial point of view, because it allows to select polymers depending on the parts to be produced.

What is claimed is:

1. An electric connector for the assembly of at least one branch cable onto a main cable of the type comprising a lower body and an upper body both having contact blades, means for accommodating said cables between the two bodies, as well as clamping means, wherein the means for accommodating the branch cable/s comprise a tube having apertures for the passage of the ends of the contact blades, the blades being disposed in flexible insulating cleats, accommodated in housings formed in the lower and upper bodies, only the ends of the contact blades protruding out of these cleats.

2. An electric connector as claimed in claim 1, wherein said cleats penetrate said apertures of said tube so that continuity of electric insulation is ensured.

3. An electric connector as claimed in claim 1, wherein said tube comprises shutting means at the two entries.

4. An electric connector as claimed in claim 1, wherein each of said two bodies has a Y shape, with a half-base and two stems, symmetric with respect to a median plane P, as well as housings, also Y-shaped, for accommodating said blades.

5. An electric connector as claimed in claim 1, wherein said tube comprises shutting means in the median zone, also forming a position abutment for the ends of said branch cables.

6. An electric connector as claimed in claim 5, wherein said shutting means consist in open slots arranged transversely to the tube and receiving sliding flap shutters, the latter comprising elastic fingers for locking them in the inserted position.

7. An electric connector as claimed in claim 1, wherein said lower and upper bodies comprise guide pins and through holes for these pins respectively, with calibrated rupture means for keeping said tube in position during the sliding motion of said pins, and safety means for the extraction of the pins out of the holes after insertion thereof.

8. An electric connector as claimed in claim 7, wherein said tube comprises split rings provided between said two bodies for cooperation with said guide pins.

9. An electric connector for the assembly of at least one branch cable onto a main cable of the type comprising a lower body and an upper body both having contact blades, means for accommodating these cables between the two bodies, as well as clamping means, wherein the means for accommodating the branch cable/s comprise a tube having apertures for the passage of the ends of the contact blades, the clamping means including a threaded housing formed in the lower body and a screw whose shank passes through the upper body inside an elongated hole which allows reciprocal self-positioning of the two bodies upon clamping, the screw bearing a calibrated rupture clamping device such as a screw cap, molded on said screw.

10. An electric connector as claimed in claim 9, wherein each of said two bodies has a Y shape, with a half-base and two stems, symmetric with respect to a median plane P, as well as housings, also Y-shaped, for accommodating said blades.

11. An electric connector as claimed in claim 9, wherein said lower and upper bodies comprise guide pins and through holes for these pins respectively, with calibrated rupture means for keeping said tube in position during the sliding motion of said pins, and safety means against the extraction of the pins out of the holes after insertion.

12. An electric connector as claimed in claim 11, wherein said tube comprises split rings provided between said two bodies for cooperation with said guide pins.

13. An electric connector for the assembly of at least one branch cable onto a main cable of the type comprising a lower body and an upper body both having contact blades, means for accommodating these cables between the two bodies, as well as clamping means, wherein the means for accommodating the branch cable/s comprise a tube having apertures for the passage of the ends of the contact blades, the lower and upper bodies comprise guide pins and through holes for these pins respectively, with calibrated rupture means for keeping the tube in position for their sliding motion, and safety means against the extraction of the pins out of the holes after insertion.

14. An electric connector as claimed in claim 13, wherein said tube comprises split rings provided between said two bodies for cooperation with said guide pins.

15. An electric connector as claimed in claim 13, wherein each of said two bodies has a Y shape, with a half-base and two stems, symmetric with respect to a median plane P, as well as housings, also Y-shaped, for accommodating said blades.

* * * * *